United States Patent [19]

Miller et al.

[11] Patent Number: 4,698,895

[45] Date of Patent: Oct. 13, 1987

[54] METHOD OF SECURING EQUIPMENT PARTS TO A TRACKWAY SUPPORTING STRUCTURE

[75] Inventors: Luitpold Miller; Hans G. Raschbichler, both of Ottobrunn, Fed. Rep. of Germany

[73] Assignee: Thyssen Industrie AG, Fed. Rep. of Germany

[21] Appl. No.: 879,132

[22] Filed: Jun. 26, 1986

Related U.S. Application Data

[63] Continuation-in-part of Ser. No. 698,351, Feb. 5, 1985, Pat. No. 4,620,358.

[30] Foreign Application Priority Data

Feb. 6, 1984 [DE] Fed. Rep. of Germany ..... 34040617

[51] Int. Cl.[4] ..... B23Q 3/00

[52] U.S. Cl. ..... 29/464; 29/526 R; 104/281

[58] Field of Search ..... 29/445, 464, 526 R; 104/89, 286, 261

[56] References Cited

U.S. PATENT DOCUMENTS

| | | | |
|---|---|---|---|
| 3,034,611 | 5/1962 | Zenzic | 29/526 R X |
| 3,254,399 | 6/1966 | Zahuranec | 29/464 X |
| 3,511,186 | 5/1970 | Barthalon | 104/89 |
| 3,631,807 | 1/1972 | Cherto | 104/89 |
| 3,842,749 | 10/1974 | Schwarzler | 104/281 X |
| 3,885,505 | 5/1975 | Winkle et al. | 104/281 X |
| 4,064,808 | 12/1977 | Nokamura et al. | 104/281 X |

OTHER PUBLICATIONS

Glaser Annalen (German Periodical) 105 (1981), No. 7/8-pp. 205-215.

*Primary Examiner*—Charlie T. Moon
*Attorney, Agent, or Firm*—McGlew and Tuttle

[57] ABSTRACT

The feature characterizing the method is that in an operation following the finishing of the track supporting structure, the mounting bodies are machined in a way such as to correct the structural inaccuracies caused by manufacturing tolerances of the prior art steel and concrete construction, to obtain an accurate mutual position of the equipment parts at the location of attachment. For this purpose, preferably, the mounting bodies are provided at the securing locations with bores and countersinks which are accurate in all the coordinates and correspond to the bolts or bores of the equipment parts, to finally mount these parts by means of bolts and spacer bushings. The bores and countersinks are formed by computer controlled drilling machines in a workshop where the support structures are held at a position which they will ultimately have in the field.

11 Claims, 15 Drawing Figures

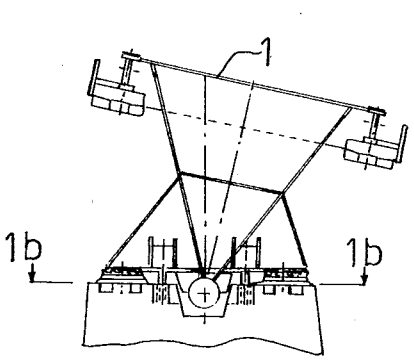
FIG. 1
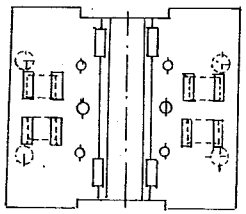
FIG. 1b
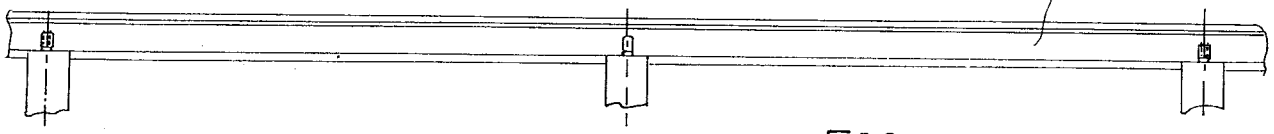
FIG. 1c
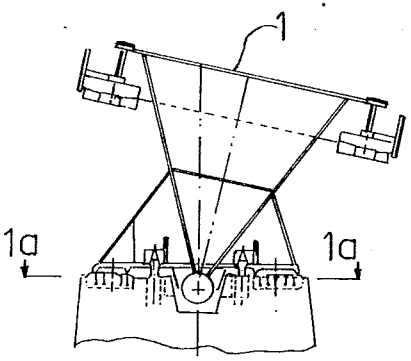
FIG. 1a
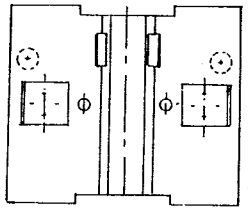

METHOD OF SECURING EQUIPMENT PARTS TO A TRACKWAY SUPPORTING STRUCTURE

CROSS REFERENCE TO RELATED APPLICATION

The present application is a continuation-in-part application of Ser. No. 698,351 filed Feb. 5, 1985 and now U.S. Pat. No. 4,620,358.

FIELD AND BACKGROUND OF THE INVENTION

This invention relates in general to transportation systems and in particular to a new and useful method of securing equipment parts to a trackway supporting structure.

Concrete or steel track structures for track-following systems of transportation, particularly magnetic suspension railroads, comprise upright single or multiple trusses, or ground sections, with the working surfaces or parts of equipment needed for support, guidance, drive, braking, data transmission to the control station, and current transmission into the vehicle such as reaction rails, current rails, etc., being mounted on the supporting structure in exact position through adjustable screw connections or by means of securing bolts or securing lugs embedded in the concrete. From U.S. Pat. No. 4,064,808 to Nakamura et al (German No. DS 27 15 717), it is known to clamp a reaction rail in place in exact position, while using adjustable screw connections to compensate for the manufacturing tolerances of the supporting concrete structure. The accurate fixing by means of embedded securing bolts is shown in the German Periodical Glaser Annalen, 105 (1981), No. $\frac{7}{8}$, pages 205–215. According to that disclosure, the needed positional accuracy is ensured directly at the site and on the actual track layout, after a preliminary accurate adjustment of the track equipment, by introducing mortar and thus fixing the securing bolts in place. This, however, requires a preceding accurate adjustment and holding of the track equipment in the adjusted position during the casting and until the mortar solidifies. The adjustable screw connection is also known from Glasers Annalen. In FIG. 13 on page 213 of the mentioned reference, it is shown how the longitudinal stator plates are connected to the track support, or the joint working component, through adjustable securing elements. Adjustable securing elements require a considerable amount of screw and connection elements, if the equipment parts are to be exactly positioned and firmly secured to the track structure, and the mounting costs, up to the final adjustment of the parts in positions variable by screwing, are high. The working components and equipment parts can be structurally united only in few individual instances, since frequently materials are needed for the equipment parts having coefficients of expansion different from those of steel and concrete, or the construction does not allow such a unification, for example, a laminated stator for a longitudinal stator drive fixed to the track, or a correspondingly exact fabrication of the working surface as a component of the supporting structure are not feasible technically or justifiable economically.

SUMMARY OF THE INVENTION

Starting from this prior art, the invention is directed to a method permitting the fixing of the equipment parts to the supporting structure of the trackroad in a simple way, i.e. with a small number of securing elements and adjustment devices and with a minimum of mounting costs.

Accordingly, it is an object of the invention to provide an improved method for securing equipment parts in accurate positions to a structure supporting a track following system of transportation, particularly a magnetic suspension railroad which comprises constructing a supporting structure and in accordance with the layout of the track in reference to the working surfaces of the parts of equipment, connecting mounting bodies to the supporting structure which have a plurality of thruholes and countersinks of a number needed for mounting the part of equipment corresponding to the respective bolts and bores thereof and being made to exact dimensions in all coordinates.

A further object of the invention is to provide a method of erecting a support structure which includes a trackway and a plurality of equipment parts secured to the structure which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a diagrammatical transverse sectional view of a trackway structure constructed in accordance with the invention;

FIG. 1*a* is a section taken along the line 1*a*—1*a* of FIG. 1;

FIG. 1*b* is a section taken along the line 1*b*—1*b* of FIG. 1;

FIG. 1*c* a side elevational view of the trackway shown in FIG. 1.

FIG. 8 is a side elevational view of the pile on and parts of two rail support structures on the pile on.

DESCRIPTION OF THE PREFERRED EMBODIMENTS

Figure 2B:
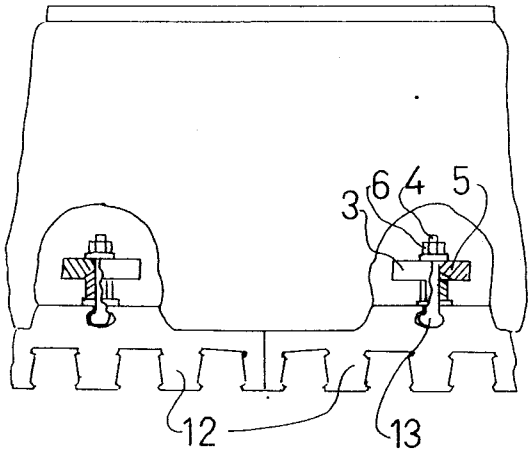
FIG. 2*b* is a section taken along the line 2*b*—2*b* of FIG. 2*a;*
Figure 2A:
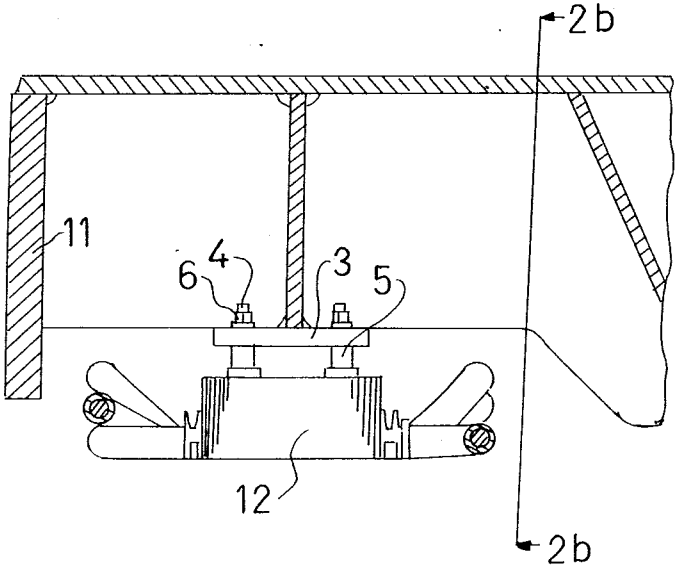
FIG. 2*a* is an enlarged detail of a portion of the structure shown in FIG. 1 indicating the method of mounting additional equipment in accordance with the invention.

Referring to the drawings in particular the invention embodied therein comprises a method of securing equipment parts in accurate positions at predetermined locations of connections to a structural supporting track following system of transportation which is indicated in FIG. 1. In accordance with the invention, a magnetic suspension railroad has a supporting structure which includes mounting bodies which are provided at locations of attachment and dimension for transferring to the supporting structure forces and torques which act through the vehicle onto the parts of the equipment. With the inventive method, the supporting structure is completed and in accordance with the layout of the track as referred to the working surface of the parts of equipment. Mounting bodies are connected to the supporting structure and are thereafter provided with a plurality of thruholes and countersinks of a number needed for mounting the part of the equipment corresponding to the respective bolts and bores thereof and having the exact dimensions in all coordinates. The track supporting structure may be made of steel and the mounting bodies are accessible from both sides and provided with bores and countersinks which are exact in all coordinates and the equipment is mounted by means of bolts, spacer bushings and nuts. The mounting bodies may also be connected to the untensioned reinforcement of steel reinforced concrete forming the structure and backed with a filling material at their side facing the concrete. A foam material may be employed as filling material.

Figure 4:
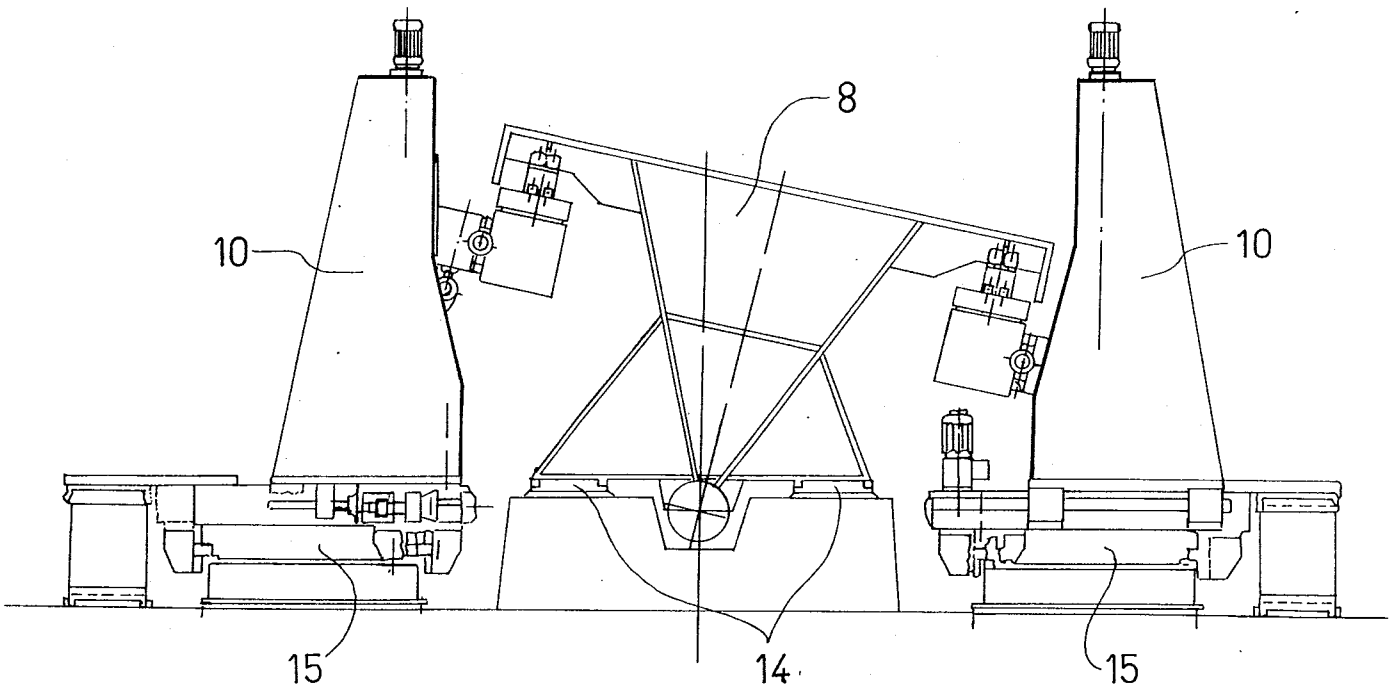
FIG. 4. is a view of the steal frame rail support structure indicating computer control drilling devices employed in accordance with the invention.
Figure 5:
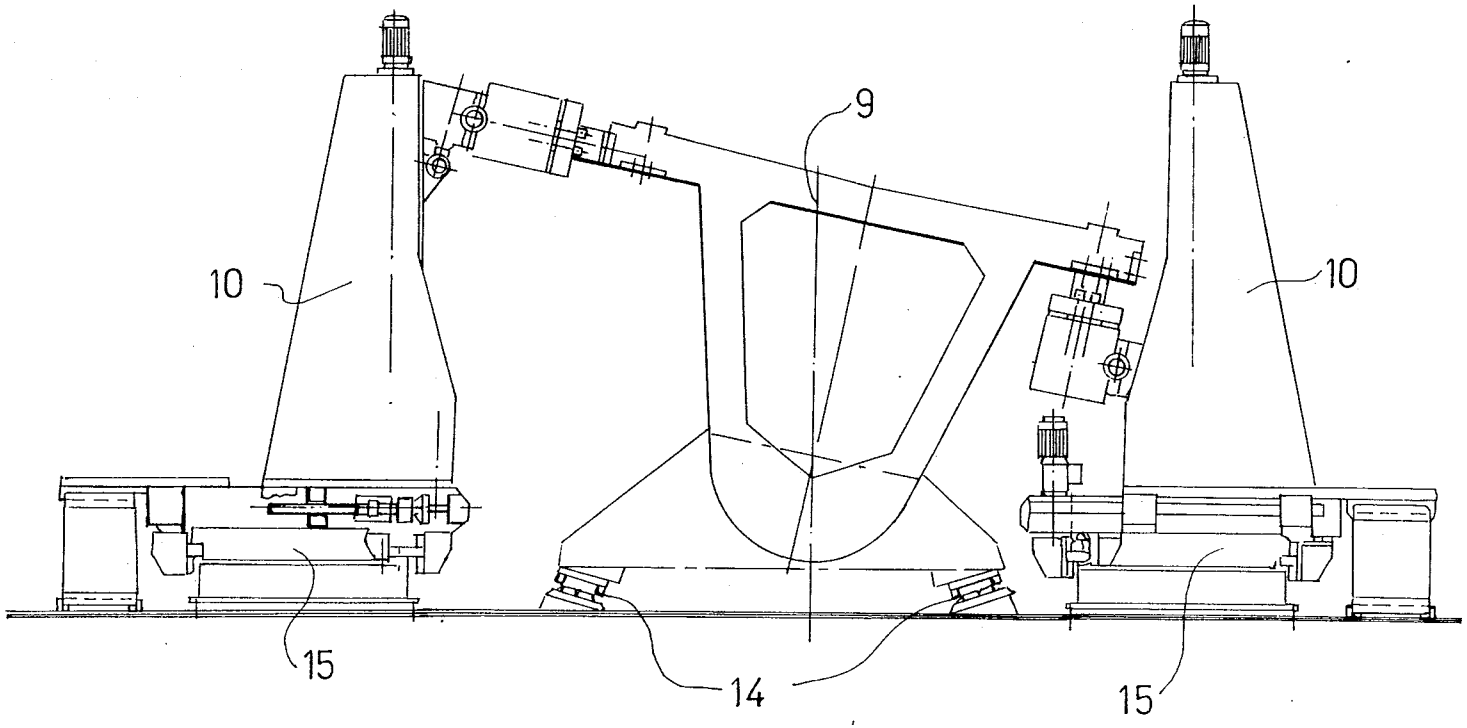
FIG. 5 is a view similar to FIG. 4 of another embodiment of the invention, with a steel re-enforced concrete rail support stucture.

When the track supporting structures are designed as steel supports, reinforced concrete supports or structural units of ground track road, mounting bodies are drilled and countersunk by means of one or more computer controlled drilling tool as shown in FIGS. 4 and 5.

Figure 3A:
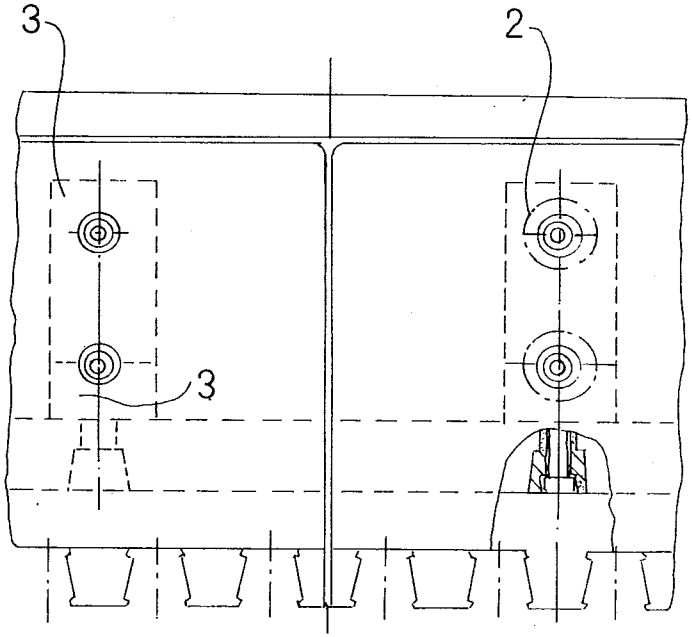
FIG. 3A is a section taken along the line 3A—3A of FIG. 3.
Figure 3:
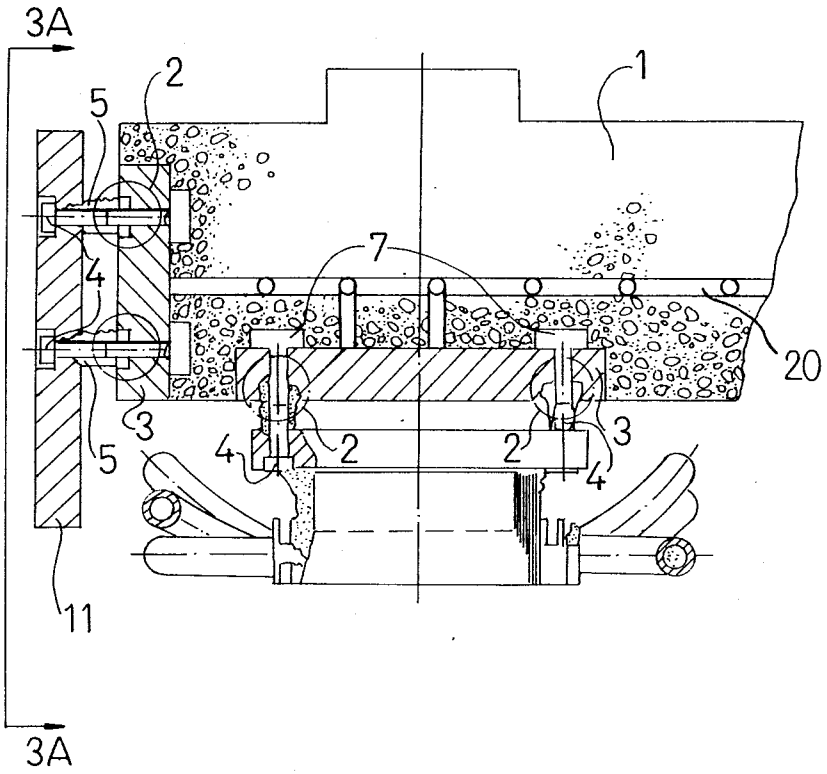
FIG. 3 is an enlarged sectional view showing the manner of securing the equipment to a concrete structure.

As may be learned from FIGS. 2*a*, 2*b*, 3 and 3A, only bolts 4 and spacer bushings 5 are needed for securing equipment parts, such as a lateral guide rail 11 or magnetic coil devices 12 to a concrete track through mounting bodies 3 at attachment locations 2, with the mounting bodies being backed in the concrete, in line with the bores, with a foam filler material 7. The stator plates are secured similarly. FIG. 3 shows the untensioned reinforcement 20 of the steel concrete 1, to which mounting bodies 2 which are in the form of flat plates, are connected.

The securing shown in FIG. 2, of stator plates 12 to a steel track 1 requires only sliding blocks 13 with bolts 4, collets 5, and nuts 6. As shown, the minimum number of needed mounting parts and the simple way of fixing by non-adjustable screw connections reduce the mounting expenses to a minimum and, since the securing becomes so simple, makes possible a large scale automation. An accurate positioning of the track equipment can thus be obtained with very small costs.

The accurate location of the corresponding thruholes, tapped holes, and countersinks, can be obtained in a particularly economical way by employing computer controlled drilling devices 10 shown in FIGS. 4 and 5. To this end, the track support 8 (FIG. 4) or 9 (FIG. 5), or the track supporting structure in accordance with the bearings 14 provided at the respective location of a track, is immobilized and then the mounting bodies are provided with accurately positioned and dimensioned bores, countersinks, and tapholes computed from the required layout of the track. The same guide rails 15 on which the drilling devices are guided in the longitudinal direction of the track structure or track supports, may then be used for fully automatically mounting the equipment parts on the supporting structure.

Figure 6A:
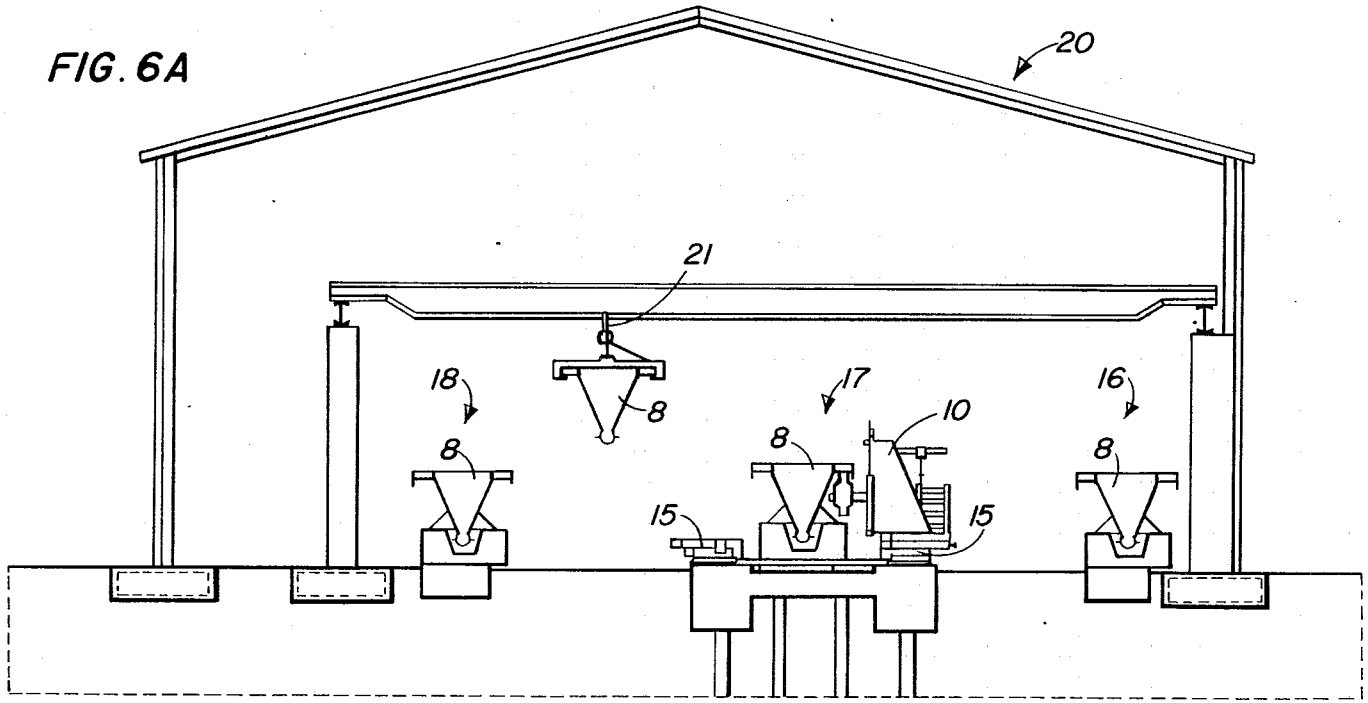
FIG. 6A is a side elevational view taken through a workshop where steel frame rail support structures are being processed in accordance with the invention.
Figure 6B:
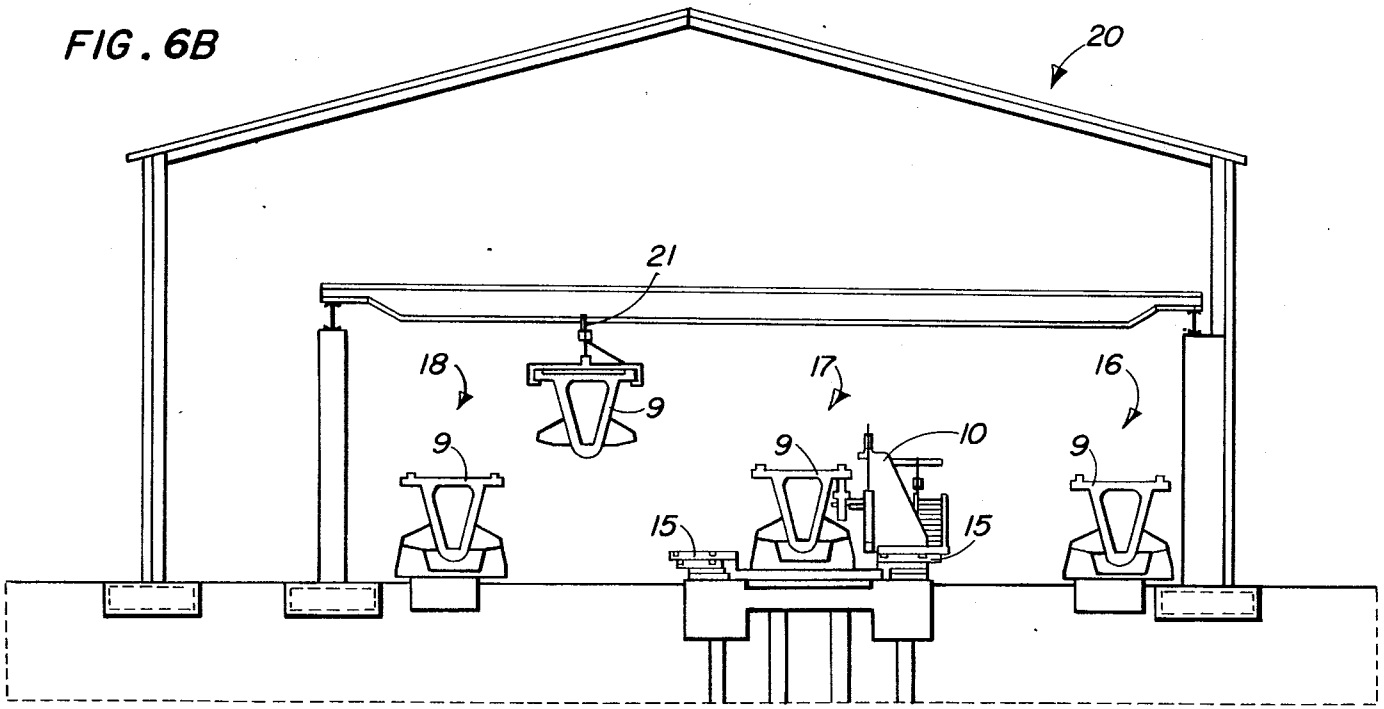
FIG. 6B is a view similar to FIG. 6A showing a workshop where steel reinforced concrete rail support structures are being processed.

As shown in FIG. 5, the computer controlled drilling devices 10 are mounted on respective workhouse tracks 15 which are positioned on opposite sides of bearings 14 for the steel frame structure 8 (FIG. 6A) or the reinforced concrete structure 9 (FIG. 6B).

The method of the invention is accomplished within a workshop generally designated 20 in FIGS. 6A and 6B. These two Figures differ only in that FIG. 6A is shown for processing steel framed track supporting structures 8 while FIG. 6B is used for processing reinforced concrete track supporting structures 9. Other structures in the workshops are the same. In accordance with the invention, each track supporting structure 8 or 9 is brought into workshop 20 to a tempering station 16. The track supporting structures can be moved from one station to another by an overhead crane 21.

The track supporting structures are already provided with their mounting bodies 3 but the mounting bodies have not yet been provided with the thruholes or countersinks.

The workhouse is long enough (into the plane of FIGS. 6A and 6B) to receive at least one track supporting structure. The workhouse may be longer for receiving more than one supporting structure.

Each supporting structure is first exposed to a known tempering process at tempering station 16. Since the humidity and temperature in the workhouse 20 is controlled, fluctuations due to expansion or contraction of the track supporting structures is avoided, all track supporting structures having been stablized to the same temperature in the workhouse 20.

Figure 7:
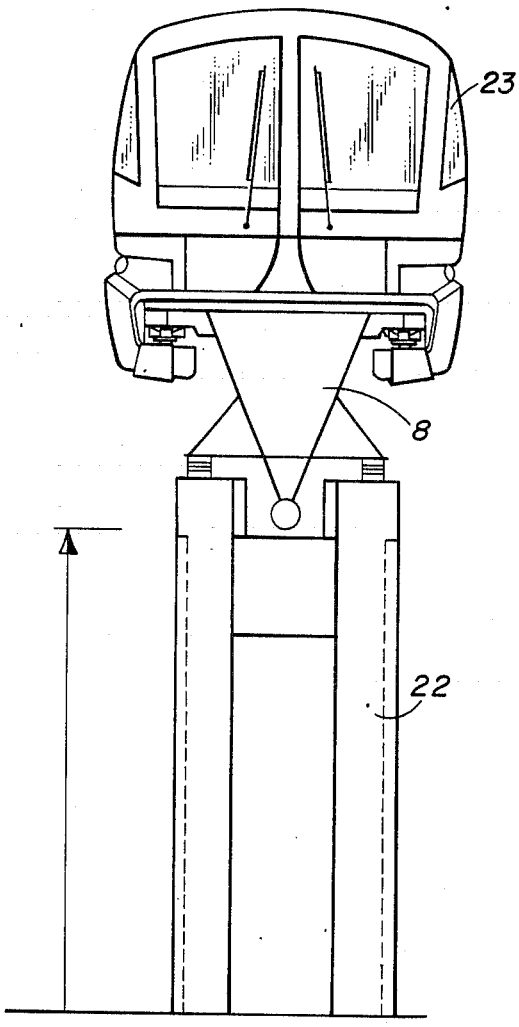
FIG. 7 is a front elevational view taken through a rail support structure after it has been installed on a pile on at a railroad layout site in the field, showing a magnetic suspension vehicle on rails of the rail support structure.
Figure 8:
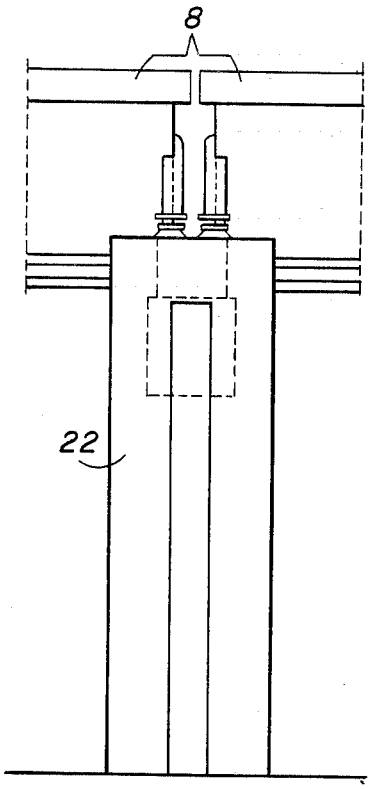
Figure 9:
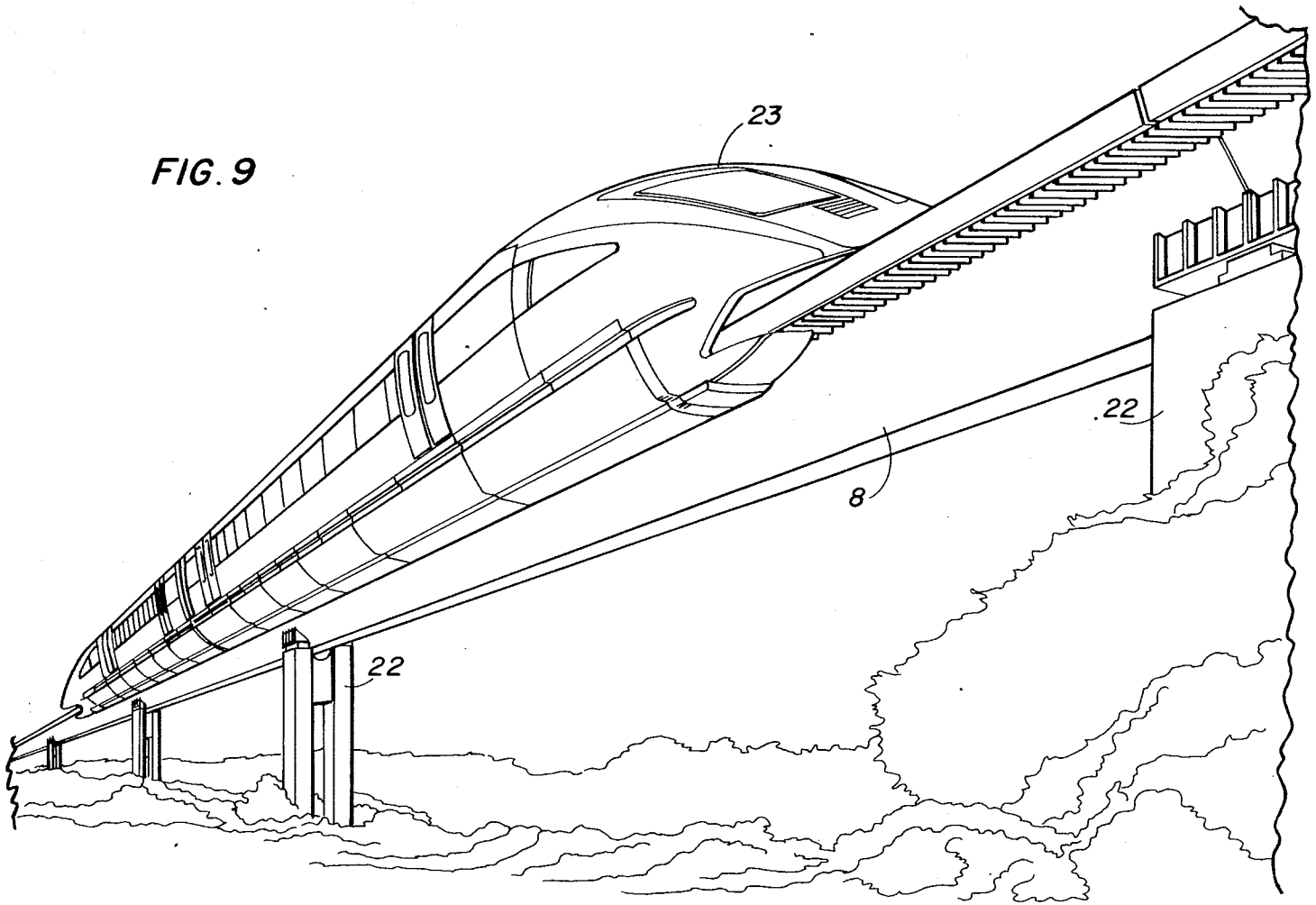
FIG. 9 is a perspective view showing rail support structures on their pile on with rails and with a magnetic suspension vehicle on the rails along a section of actual track layout in the field.

After the tempering process at tempering station 16, crane 21 brings the supporting structure 8 or 9 to a machining or equipment system 17. At equipment station 17, the track supporting structure is mounted on the bearings 14 (see FIG. 5) to bring it into a correct orientation. This is the same orientation that this particular track supporting structure will have in its final layout in the field. Examples of this field layout for the track supporting structures are shown in FIGS. 7, 8, and 9. FIGS. 7 and 9 also show how a magnetic suspension railroad vehicle 23 can be guided on tracks which are connected to the track supporting structures. The track supporting structures will have various inclinations depending on whether the structure is in a straight section of track or along a banked curved section of track. The track support structures are positioned on pile on 22 or may be connected to short pedestals which bring the track supporting structure near the ground. The track layout may of course also enter tunnels as is known in the art.

Returning to FIGS. 6A and 6B, with the track supporting structure in the equipment position 17 and positioned in the way it will ultimately be positioned in the field, the computer controlled drilling devices 10 are moved along their tracks 15 which are on opposite sides of the track supporting structure 18, to automatically drill and countersink the thruholes in each of the mounting bodies that are already affixed to the track supporting structure. It is noted that the computer drilling equipment is first programmed according to the track layout in the field where the structural supports will ultimately be mounted (FIGS. 7 thru 9). The layout is thus reduced to data on the position for each of the mounting bodies and each of the thruholes, and this data is used in the program for moving the drilling equipment 10.

After the thruholes and countersinks are formed at equipment station 17, overhead crane 21 moves the track supporting structure to a factory testing station 18 where quality control tests are conducted for the entire track supporting structure.

The completed track supporting structure can then be removed from the workhouse 20 and brought to the actual track layout in the field. The equipment in the form of rails 11 or magnetic devices 12, for example, can be mounted to the track supporting structures either in the workhouse 20 or in the field. The important feature of the invention is that the thruholes and countersinks need not be made in the field but in fact are made in the workhouse under controlled conditions and with the track supporting structure in an orientation which it will ultimately have in the field.

While specific embodiments of the invention have been shown and described in detail to illustrate the application of the principles of the invention, it will be understood that the invention may be embodied otherwise without departing from such principles.

What is claimed is:

1. A method of securing equipment parts in accurate positions at predetermined locations of connection to a structure supporting a track following system of transportation, particularly a magnetic suspension railroad, comprising providing mounting bodies for the track supporting structure at locations of attachment and dimensioned for transferring to the track supporting structure forces and torques which act through a vehicle, connecting the mounting bodies at the desired attitude to the supporting structure in accordance with the layout of the track as referred to working surfaces of the parts of equipment, providing the mounting bodies after they are connected to the supporting structure with a plurality of thruholes and countersinks by drilling in a number needed for mounting the equipment part corresponding to the respective bolts and bores thereof and having the exact dimensions in all coordinates, securing equipment parts to the mounting bodies using exact dimensioned bolts received in the holes drilled therein, and laying out a plurality of the supporting structures to form a layout of the track.

2. A method according to claim 1, wherein the track supporting structure is constructed of steel reinforced concrete, said mounting bodies being connected to untensioned steel reinforcement of the steel reinforced concrete and backed with a filling material at side faces of the steel reinforced concrete.

3. A method according to claim l, wherein said track supporting structure is made of steel and wherein said mounting bodies are accessible from both sides and provided with bores and countersinks which are exact in all coordinants and including mounting the equipment parts by means of bolts, spacer bushing and nuts.

4. A method according to claim 2, wherein foam material is employed as the filling material.

5. A method according to claim 1 including drilling the thruholes and countersinks using at least one computer controlled drilling machine.

6. A method according to claim 5 including positioning said track supporting structure in a workshop and at an attitude which the track supporting structure will ultimately have in the layout of the track, programming the computer controlled drilling machine to place the thruholes and countersinks according to data concerning the position and orientation of the thruholes and countersinks that the thruholes and countersinks will ultimately have at the layout of the track, and moving the computer controlled drilling tools along the track supporting structure to drill the thruholes and countersinks.

7. A method according to claim 6 including controlling the temperature in the workshop and positioning the track supporting structure in the workshop for sufficient time so that the track supporting structure reaches a desired temperature before drilling the thruholes and countersinks.

8. A method according to claim 7 including controlling the humidity in the workshop and positioning the track supporting structure in the workshop for a sufficient period of time so that the humidity condition affects the track supporting structure to a known extent before drilling the thruholes and countersinks.

9. A method of securing equipment parts at accurate positions and at predetermined locations to track the supporting structures of a magnetic suspension railroad, comprising:

connecting mounting bodies to each track supporting structure;

positioning each track supporting structure in a work house having a controlled environment, the track supporting structure being positioned at a selected known attitude which corresponds to an attitude the track supporting structure will ultimately have in a layout of track;

using a computer controlled drilling machine to drill thruholes and countersinks in the mounting bodies at selected positions corresponding to data used to control the drilling machine, the data corresponding to dimensions and positions of the thruholes and countersinks which are ultimately needed in the layout of track; and mounting the track supporting structure after drilling the thruholes and countersinks in the layout of track.

10. A method according to claim 9 including securing the. equipment parts to the mounting bodies by using bolts which extend through the thruholes and countersinks while the track supporting structure is in the workshop.

11. A method according to claim 9 including securing the equipment parts to the track supporting structure by using bolts which extend into the thruholes and countersinks while the track supporting structure is in the layout of track.

* * * * *